US006854923B2

(12) United States Patent
Greppmair

(10) Patent No.: US 6,854,923 B2
(45) Date of Patent: Feb. 15, 2005

(54) WORKING MACHINE WITH REDUCED UPPER MASS VIBRATIONS

(75) Inventor: Martin Greppmair, Munich (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/784,429

(22) Filed: Feb. 24, 2004

(65) Prior Publication Data

US 2004/0165953 A1 Aug. 26, 2004

Related U.S. Application Data

(63) Continuation of application No. 09/508,356, filed as application No. PCT/EP98/05392 on Aug. 25, 1998.

(30) Foreign Application Priority Data

Sep. 10, 1997 (DE) ..... 197 39 743

(51) Int. Cl.[7] ..... E01C 19/32
(52) U.S. Cl. ..... 404/133.1; 404/133.05

(58) Field of Search ..... 404/133.1, 133.05, 404/133.2

(56) References Cited

U.S. PATENT DOCUMENTS 3,957,309 A * 5/1976 Darda ..... 299/22
4,557,336 A * 12/1985 DeNise ..... 173/90
5,340,233 A * 8/1994 Motl ..... 404/133.05
5,645,370 A * 7/1997 Zurbes et al. ..... 404/133.1

* cited by examiner

*Primary Examiner*—Thomas B. Will
*Assistant Examiner*—Raymond W Addie
(74) *Attorney, Agent, or Firm*—Boyle Fredrickson Newholm Stein & Gratz S.C.

(57) ABSTRACT

A tamping machine for compacting soil has a crank mechanism for producing a directed vibration. The crank mechanism is coupled to a spring assembly. The parts of the crank mechanism which move back and forth linearly are made from a material with a density less than that of steel. This construction prevents vibrations which are unpleasant for the person operating the working machine from occurring.

7 Claims, 3 Drawing Sheets

WORKING MACHINE WITH REDUCED UPPER MASS VIBRATIONS

CROSS REFERENCE TO RELATED APPLICATION

This application is a continuation application of presently co-pending U.S. application Ser. No. 09/508,356, filed Mar. 9, 2000, and entitled "Working Machine with Reduced Upper Mass Vibration," which is a national stage entry of PCT/EP98/05392, filed Aug. 25, 1998 the entirety of which is incorporated herein by reference.

BACKGROUND OF THE INVENTION

The invention relates to a working machine according to the preamble of patent claim 1. The invention relates, in particular, to a tamping machine for soil compaction or to a hammer.

DESCRIPTION OF THE RELATED ART

Known tamping machines of this type are designed in such a way that an upper mass receiving a motor and a crank mechanism is connected via a spring assembly to a working mass which forms essentially a working or compacting plate. The rotational movement generated by the motor is converted by the crank mechanism into an oscillating axial movement which is transmitted via the spring assembly to the working plate for soil compaction. The upper mass comprises about two thirds and the percussive working mass one third of the entire tamper mass, whilst the distances covered in each case by the upper mass and the working mass are in inverse proportion to one another. The order of magnitude in which the upper mass moves in this case is 25 to 30 mm.

The vibrations of the upper mass are transmitted via a guide handle to the person guiding the working machine, and is very unpleasant, particularly when the work lasts a relatively long time. In this context, vibrations in the horizontal or lateral direction are particularly troublesome for the operator. By contrast, vibrations in the vertical direction are necessary for the tamper to work efficiently.

FIG. 2 shows a known tamper of this type.

According to FIG. 2, a drive shaft 1 of the tamper is driven by a motor, not illustrated, the drive shaft driving, via a pinion 2, a crank disk 3 mounted in the tamper housing and provided with external toothing. Attached to the crank disk 3 is a crank pin 4, onto which a connecting rod 5 is placed in a rotationally movable manner. The connecting rod 5 is connected at its other end to a guide piston 7 in a rotationally movable manner by means of a piston pin 6. The guide piston 7 carries a piston guide 9 formed by a steel disk and fastened by means of a nut 8. The guide piston 7 is movable axially back and forth, by means of the piston guide 9 within a guide tube 10 belonging to the lower mass. This axial direction corresponds to a vertical or working direction of the machine when it is being used.

A spring assembly 11 consisting of a plurality of springs is arranged on both sides of the piston guide 9, the springs in each case being supported, on their side facing away from the piston guide 9, against spring plates 12 fastened to the guide tube 10. In order to avoid the spring assemblies 11 being blocked together, a dampening bush 13 made from an elastic plastic is placed onto the guide piston 7 above the piston guide 9, whilst a damping plug 14, likewise consisting of elastic plastic, is attached below the nut 8. When the spring assemblies 11 are highly compressed, the dampening bush 13 and the damping plug 14 can in each case butt onto the associated spring plate 12 with their side facing away from the piston guide 9. They then damp the further compressive movement in such a way that the situation can be avoided where the spring assemblies 11 are blocked together and an excessive impact action is consequently exerted on the working machine.

The guide tube 10, together with the spring plates 12, belongs to the working or lower mass of the tamper. A tamping foot, not shown in FIG. 1, which serves for soil compaction may be attached to the lower mass. In order to avoid the penetration of moisture and dirt, the upper mass and the lower mass are connected by means of an elastic concertina 15.

As is apparent from FIG. 2, the rotational movement of the motor is converted into an oscillating axial movement of the guide piston 7 by the crank mechanism by means of the crank disk 3, the crank pin 4 and the connecting rod 5. This axial movement is transmitted via the spring assemblies 11 to the guide tube 10 and consequently to the lower mass and can be utilized for soil compaction.

In order to damp the vibrations acting on the operator, it has been known hitherto to uncouple the guide handle from the upper mass mechanically by means of rubber elements. In this case, however, the mounted drive motor still remains exposed to high vibrational loads. An improvement in vibration damping can be achieved here only at a high outlay in terms of construction.

It is therefore desirable, from the outset, to avoid vibrations of the upper mass occurring.

DE-A 19 25 870 discloses a tamper for soil compaction, with a working mass which is driven linearly back and forth, via a double crank mechanism, by a motor belonging to an upper mass. In order to reduce the vibrations on the upper mass, two weights moveable in opposition are provided, which superpose an oppositely directed vibration on the vibration generated by the crank mechanism. The tamper has a double-leg design, each tamper leg being driven via its own crank mechanism. The tamper correspondingly has a very large build and can be guided on the ground only with great effort.

DE-Patent 753 502 discloses a drive device for exciting vibratory systems. For this purpose, arms and levers coupled to one another via rubber springs are provided in a crank mechanism. In order to avoid harmful dynamic mass action in the form of forces reacting on the motor and the bearings, the mass of the arms and levers is kept as low as possible, using materials of low specific gravity.

OBJECTS AND SUMMARY OF THE INVENTION

The object on which the invention is based, therefore, is to specify a working machine in which vibrations of the upper mass can be avoided as soon as they occur.

The object is achieved, according to the invention, by means of a working machine having the features of patent claim 1.

It was shown, surprisingly, that the vibrations of the upper mass can be reduced considerably if materials which are lighter than steel, that is to say have a lower density than steel, are used for producing the structural elements of the crank mechanism which are moveable linearly back and forth, that is to say, in particular, the connecting rod, piston pin, guide piston and piston guide. This is attributable to the fact that the mass of the upper mass is reduced due to the lower weight of the moveable components, with the result that lower forces act on the upper mass.

It is particularly advantageous if the material is an aluminum alloy or a plastic, because a particularly large reduction in mass is possible thereby.

In the working machines known hitherto, in particular in tampers, attempts have usually been made to damp the vibrations acting on the operator by vibrationally insulating the guide handle of the machine from the machine itself, for example by means of rubber elements. It was also known to reduce the upper-mass vibration by superposing an additional vibration generated separately. However, it is not yet known to reduce the vibrations as soon as they occur by the use of lightweight components.

In addition to reducing the movement of the upper mass, the reduction in mass of the moved components also has the advantage of saving energy, since lower masses have to be accelerated and decelerated during each crank revolution. The overall weight of the machine can likewise be reduced. On account of the lower accelerative load on the drive motor, longer service lives can be achieved. On the other hand, assuming the same power output of the motor, it is possible to use somewhat wider or heavier tamping plates, whilst at the same time ensuring the same upper-mass movement or acceleration. Furthermore, the running noise can be reduced. Moreover, considerable cost reductions may be expected in a corresponding production method. The essential advantage, however, is the reduction in the hand-arm vibrations acting on the operator, thereby making it possible to work in greater comfort.

In a particularly advantageous embodiment, the piston guide can be produced from plastic in one piece together with a dampening bush, preferably with two dampening bushes. In addition to the mass reduction mentioned, this leads to a simplification of the production method and therefore likewise to a cost reduction.

BRIEF DESCRIPTION OF THE DRAWINGS

This and other features of the invention are explained in more detail below with the aid of the figures, of which.

DETAILED DESCRIPTION OF THE PREFERRED EMBODIMENT

Figure 1:
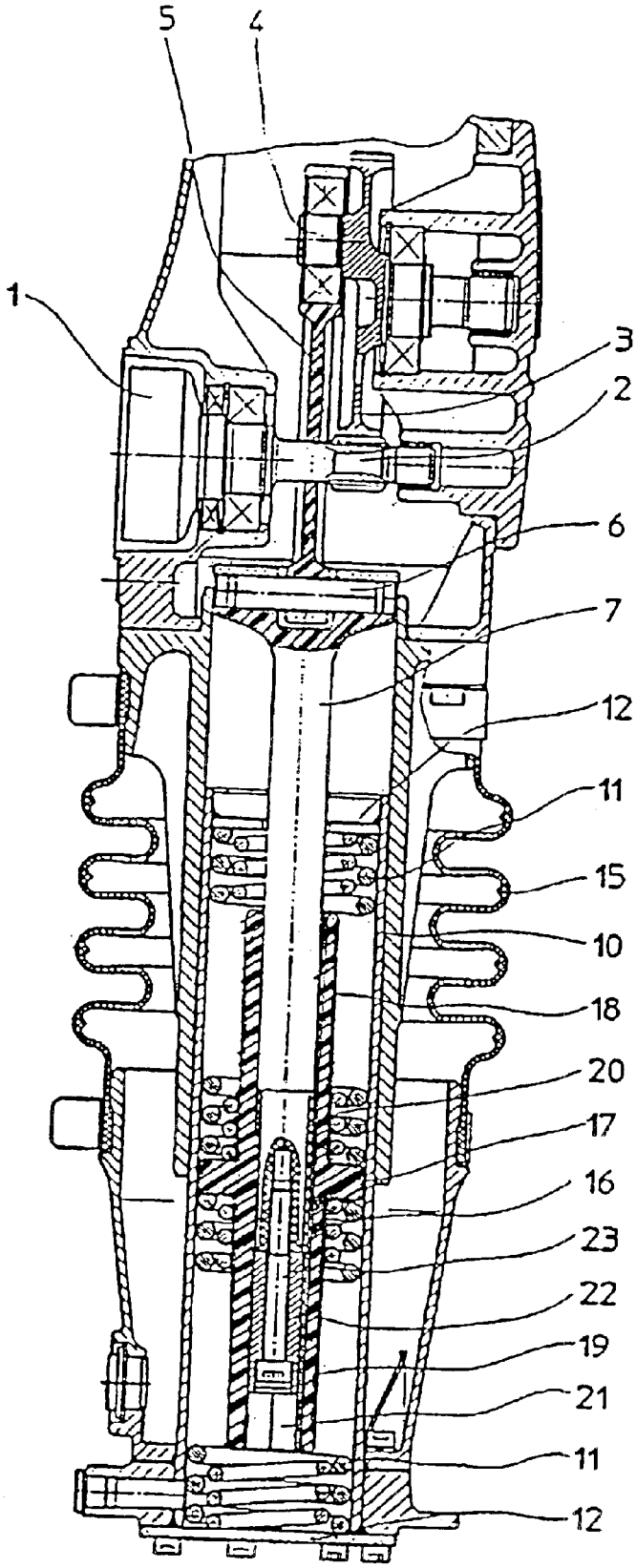
FIG. 1 shows a sectional illustration of part of a tamping machine according to the invention.

Since essential structural elements of the tamping machine according to the invention as shown in FIG. 1 correspond to the known elements already described in connection with FIG. 2, there is no need for a renewed description. For the sake of simplification, the same reference symbols are also used for identical components in the figures.

Figure 2:
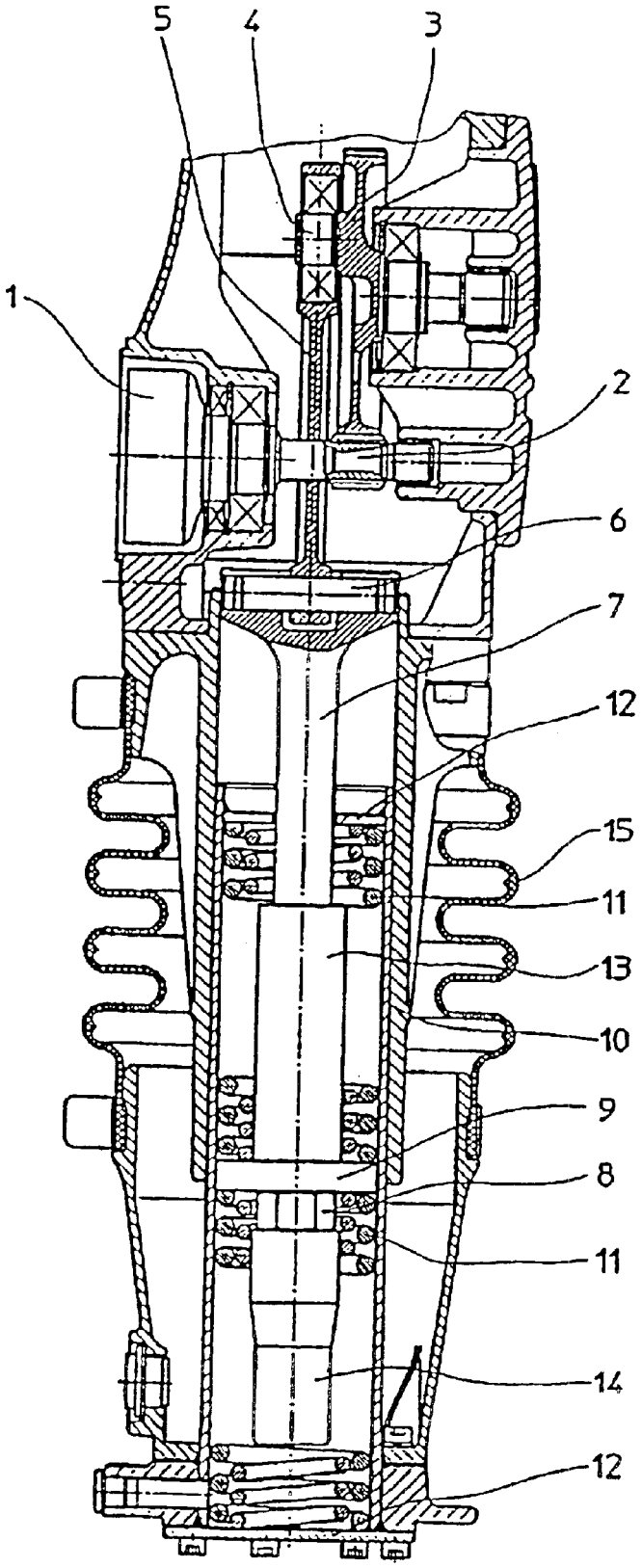
Figure 2 Prior Art
FIG. 2 shows a part section through a known tamping machine, appropriately labeled "Prior Art".

In contrast to the known tamper shown in FIG. 2, in the tamper according to the invention shown in FIG. 1, some of the structural elements of the crank mechanism which are movable linearly back and forth are produced from materials which have a lower density than steel and are therefore lighter than steel. Depending on the overall size and performance of the tamper, a decision must be made, in each individual case, as to which structural elements must be produced from lighter materials. In principle, however, in order to avoid upper mass vibrations, the aim is for as many structural elements as possible to have a lightweight design.

The relevant structural elements are the connecting rod 5, the piston pin 6, the guide piston 7 and a piston guide 16 designed according to the invention. The crank mechanism itself consists of the crank disk 3, the crank pin 4, the connecting rod 5, the piston pin 6, the guide piston 7 and the piston guide 16.

Figure 1A:
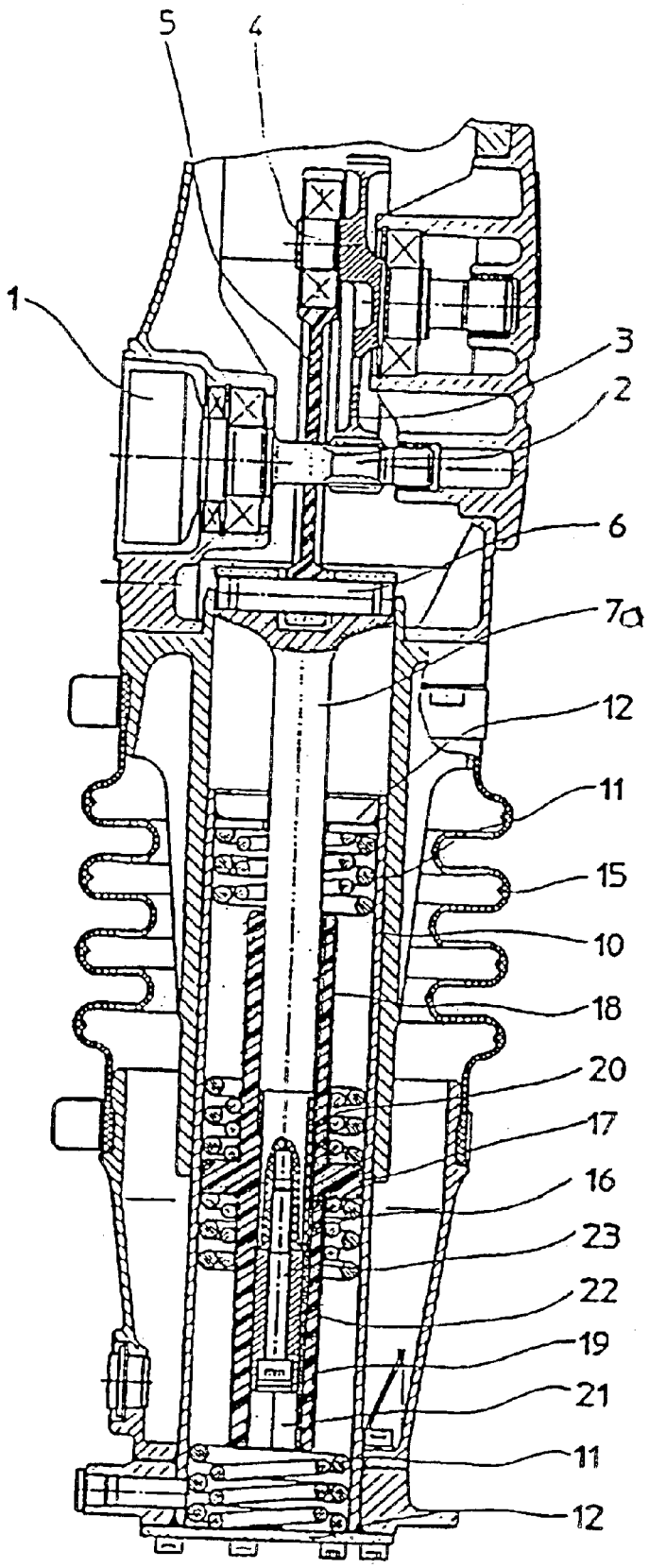
FIG. 1*a* shows a sectional illustration of part of another embodiment according to the invention.

The connecting rod 5 may be produced preferably from plastic, for example from carbon fiber- or glass fiber-reinforced polyamide. A glass fiber-reinforced polyamide is suitable for the guide piston 7. Alternatively, a wrought aluminum alloy could be employed for the guide piston as indicated by the metallic piston 7*a* in FIG. 1*a*.

The connecting rod 5 consisting of plastic has some elasticity and therefore spring properties. This elasticity is assisted by an o-leg shape, that is to say by an arcuate run of the connecting rod 5 between the crank pin 4 located on the crank disk 3 and the piston pin 6 arranged on the guide piston 7. The connecting rod 5 therefore forms an oval "O", through the center of which the drive shaft 1 extends. The lateral legs of the "O" improve the springing or damping capacity of the connecting rod 5, with the result that the bearings and toothings and also other components connected to the connecting rod 5 are protected.

The piston guide 16 integrates in one component the steel piston guide known from the prior art, the expansion bush consisting of an elastic plastic and the expansion plug. The piston guide 16 has, approximately in the middle, a wider edge 17, against the two sides of which the spring assemblies 11 come to bear. A sleeve extends from the edge 17 in each of the two directions, an upper expansion sleeve 18 being slipped over the guide piston 7 and a lower expansion sleeve 19 likewise extending in sleeve form in the direction of the lower mass. In order to avoid the spring assemblies 11 being blocked together, if strong vibration occurs the ends of the expansion sleeves 18, 19 can butt onto the respective spring plates 12 before the spring turns touch one another. An excessive impact load on the machine is thereby avoided. In order to ensure a corresponding damping capacity of the piston guide 16, the latter is produced in one piece from polyurethane. In order to reinforce the edge 17, in particular to avoid the piston guide 16 being damaged by the spring assemblies 11 resting on it, it is possible to insert thin steel disks between the edge 17 and the associated springs 11.

The piston guide 16 is screwed on the guide piston 7 via a trapezoidal thread 20. The trapezoidal thread 20 ensures contact over a large area between the piston guide 16 and the guide piston 7, so that the local surface pressure can be kept low.

For the prevention of rotation, there is formed inside the lower expansion sleeve 19 an inner hexagon 21, into which a steel piece 22 having an outer hexagon can be pushed and can be fixed to the guide piston 7 by means of a screw 23. This arrangement ensures that, when the machine is in operation, the piston guide 16 cannot independently unscrew itself down from the guide piston 7.

The invention was explained above in terms of a tamping machine according to the invention for soil compaction. Furthermore, the invention may likewise be used highly advantageously in a hammer, for example a compression hammer, since percussion generation in the hammer is based on the same principle as in the tamping machine. The fact that, in the hammer, a pneumatic spring percussion unit is normally used instead of the steel springs forming the spring assemblies 11 has no influence on the positive effects of the embodiment according to the invention.

A weight saving of several kilograms can be achieved by using plastics. However, this saved weight may also be added to the upper mass, so that the latter increases in mass, as compared with devices known from the prior art. The upper mass consequently becomes quieter during operation, with the result that fewer hand-arm vibrations are transmitted to the operator. The overall mass of the tamper remains constant, as compared with when the relevant components are produced from steel.

I claim:

1. A tamping machine for soil compaction, comprising:

a rotatable drive shaft connected to a motor;

a working mass linearly reciprocatable in a tamping direction to tamp soil; and a crank mechanism and a spring assembly configured to translate rotational movement of the drive shaft into the linear movement of the working mass, the crank mechanism including:

a crank disc operatively connected to the drive shaft for rotational movement therewith;

a connecting rod fabricated from an elastic material having a density lower than the density of steel, the connecting rod having an upper end operatively connected to the crank disc and a lower end;

a guide pin having an upper end pivotably connected to the second end of the connecting rod and a lower end; and a piston guide threaded onto the lower end of the guide pin.

2. The tamping machine of claim 1, wherein the connecting rod includes an O-shaped leg defining a passageway through the connecting rod.

3. The tamping machine of claim 2, wherein the drive shaft passes through the passageway in the connecting rod.

4. The tamping machine of claim 1, wherein the elastic material is selected from the group consisting of: carbon fiber-reinforced polyamide and carbon glass fiber-reinforced polyamide.

5. The tamping machine of claim 1, wherein the piston guide includes:

a central portion having first and second sides;

an upper expansion sleeve projecting from the first side of the central portion, the upper expansion sleeve receiving a portion of the guide pin therein; and a lower expansion sleeve extending from the second side of the central portion.

6. The tamping machine of claim 5, wherein the central portion, the upper expansion sleeve and the lower expansion sleeve of the piston guide are integrally fabricated from polyurethane.

7. The tamping machine of claim 5, wherein the upper expansion sleeve of the guide piston includes an inner surface, the inner surface having a trapezoidal thread for connecting the piston guide to the guide pin.

* * * * *